US010253630B2

(12) United States Patent
Shimazu et al.

(10) Patent No.: US 10,253,630 B2
(45) Date of Patent: Apr. 9, 2019

(54) FLUID ROTARY MACHINE

(71) Applicant: AIR SURF INC., Tokyo (JP)

(72) Inventors: Isao Shimazu, Inazawa (JP); Fumito Komatsu, Shiojiri (JP); Satoru Washio, Tokyo (JP)

(73) Assignee: AIR SURF MARKETING INC., Tokyo (JP)

( * ) Notice: Subject to any disclaimer, the term of this patent is extended or adjusted under 35 U.S.C. 154(b) by 284 days.

(21) Appl. No.: 15/121,891

(22) PCT Filed: Feb. 19, 2015

(86) PCT No.: PCT/JP2015/054586

§ 371 (c)(1),
(2) Date: Aug. 26, 2016

(87) PCT Pub. No.: WO2015/129543

PCT Pub. Date: Sep. 3, 2015

(65) Prior Publication Data

US 2017/0022811 A1 Jan. 26, 2017

(30) Foreign Application Priority Data

Feb. 28, 2014 (JP) ..... 2014-038051

(51) Int. Cl.
*F01B 1/06* (2006.01)
*F04B 5/02* (2006.01)
(Continued)

(52) U.S. Cl.
CPC ..... *F01B 1/062* (2013.01); *F01B 1/06* (2013.01); *F01B 9/023* (2013.01); *F02B 75/22* (2013.01);
(Continued)

(58) Field of Classification Search
CPC ..... F01B 1/062; F01B 1/06; F01B 1/0452; F01B 1/0531; F01B 9/023; F04B 1/0452;
(Continued)

(56) References Cited

U.S. PATENT DOCUMENTS 663,091 A 12/1900 Garretson
749,958 A * 1/1904 Crompton ..... F01L 7/02 123/190.6
(Continued)

FOREIGN PATENT DOCUMENTS

EA 2495395 A1 9/2012
FR 958132 A 3/1950
(Continued)

OTHER PUBLICATIONS

Extended European Search Report dated Oct. 9, 2017, for European Application No. 15754948.6.
(Continued)

*Primary Examiner* — Thomas E Lazo
*Assistant Examiner* — Richard C Drake
(74) *Attorney, Agent, or Firm* — Birch, Stewart, Kolasch & Birch, LLP

(57) ABSTRACT

The object of the present invention is to provide a fluid rotary machine in which dead spaces can be reduced as much as possible even if the machine is enlarged by arranging rotary valves directly behind cylinder chambers. The fluid rotary machine in which first and second double-headed pistons (7, 8) intersecting within a case body (1, 2) move linearly back and forth within cylinders (16) due to the hypocycloid principle along with rotation of shafts (4*a*, 4*b*) and in which intake and exhaust cycles are repeated in chambers (22), wherein cylinder heads (17) for closing the cylinder chambers (22) are each provided with rotary valves (19) which are rotated by drive transmission from the shafts
(Continued)

(4*a*, 4*b*) and which are provided with intake holes and discharge holes (19*b*) alternately communicated with the cylinder chambers (22) via communication channels (20*a*, 20*b*), and the rotary valves (19) intersect longitudinal axis of the opposing pistons (7, 8) and are capable of rotating parallel with output axil lines.

7 Claims, 13 Drawing Sheets

(51) Int. Cl.

| | |
|---|---|
| ***F02B 75/22*** | (2006.01) |
| ***F02B 75/32*** | (2006.01) |
| ***F01B 9/02*** | (2006.01) |
| ***F04B 1/04*** | (2006.01) |
| ***F04B 1/053*** | (2006.01) |
| ***F04B 7/00*** | (2006.01) |
| ***F04B 53/16*** | (2006.01) |
| *F01L 7/02* | (2006.01) |

(52) U.S. Cl.
CPC ..... *F02B 75/32* (2013.01); *F04B 1/0452* (2013.01); *F04B 1/0531* (2013.01); *F04B 5/02* (2013.01); *F04B 7/0007* (2013.01); *F04B 53/162* (2013.01); *F01L 7/021* (2013.01); *F01L 7/022* (2013.01)

(58) Field of Classification Search
CPC ..... F04B 1/0531; F04B 7/0007; F04B 5/02; F02B 75/22; F02B 75/32
USPC ..... 91/182, 180; 123/190.1
See application file for complete search history.

(56) References Cited

U.S. PATENT DOCUMENTS 1,115,470 A * 10/1914 Lipman ..... F01L 7/02 91/180
3,301,236 A * 1/1967 Bratton ..... F01L 7/10 123/190.4
3,405,701 A * 10/1968 Mealin ..... F01L 7/021 123/190.4
3,581,626 A * 6/1971 Matthews ..... E04F 15/02441 91/180
3,608,308 A 9/1971 Cary et al.
3,685,923 A * 8/1972 Hutchins ..... F04B 27/0428 417/273
4,279,225 A * 7/1981 Kersten ..... F01L 7/029 123/190.5
4,517,938 A * 5/1985 Kruger ..... F01L 7/021 123/190.17
5,049,039 A * 9/1991 Knoth ..... F01B 1/062 123/54.2
5,152,259 A * 10/1992 Bell ..... F01L 7/026 123/190.1
5,315,967 A * 5/1994 Schoell ..... F01B 1/062 123/54.3
5,431,130 A * 7/1995 Brackett ..... F01B 9/023 123/190.2
5,503,038 A * 4/1996 Aquino ..... F01B 9/06 123/197.1
5,579,730 A * 12/1996 Trotter ..... F01L 7/026 123/190.17
5,738,051 A * 4/1998 Binversie ..... F01L 3/205 123/317
5,782,213 A * 7/1998 Pedersen ..... F01B 9/026 123/197.4
5,839,411 A * 11/1998 Schoell ..... F01B 1/062 123/446
5,934,229 A * 8/1999 Li ..... F01B 9/023 123/192.2
5,953,914 A * 9/1999 Frangipane ..... F01B 17/04 60/370
5,967,016 A * 10/1999 Simonds ..... F02B 75/32 192/41 A
6,308,677 B1 * 10/2001 Bohach ..... F01L 7/021 123/190.1
7,150,259 B2 * 12/2006 Schmied ..... F01B 15/002 123/197.5
7,654,802 B2 * 2/2010 Crawford, Jr. ..... F04B 23/06 417/273
8,459,227 B2 * 6/2013 Cotton ..... F01L 7/02 123/188.4
8,776,756 B2 * 7/2014 Cotton ..... F01L 5/00 123/188.5
2009/0217904 A1 * 9/2009 Lee ..... F01B 9/047 123/25 P
2012/0177524 A1 * 7/2012 Komatsu ..... F01B 1/062 418/161
2013/0133511 A1 * 5/2013 Ishida ..... F03C 1/053 91/172
2014/0144405 A1 * 5/2014 Sullivan, IV ..... F01L 7/00 123/197.4

FOREIGN PATENT DOCUMENTS

| | | | |
|---|---|---|---|
| JP | 56-141079 | A | 11/1981 |
| JP | 1-106910 | A | 4/1989 |
| JP | 4-143407 | A | 5/1992 |
| JP | 9-68013 | A | 3/1997 |
| JP | 2011-117432 | A | 6/2011 |
| WO | WO 2012/017820 | A1 | 2/2012 |

OTHER PUBLICATIONS

International Search Report, issued in PCT/JP2015/054586, dated May 26, 2015.

* cited by examiner

SECTION P-P

SECTION P-P

FIG.7E
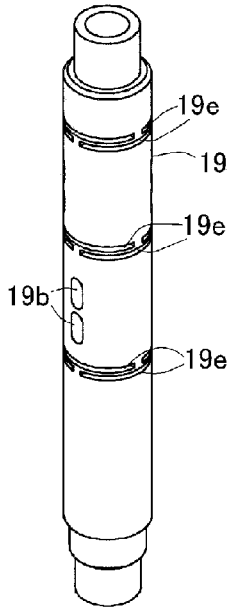
FIG.7B
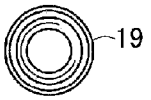
FIG.7C
FIG.7A
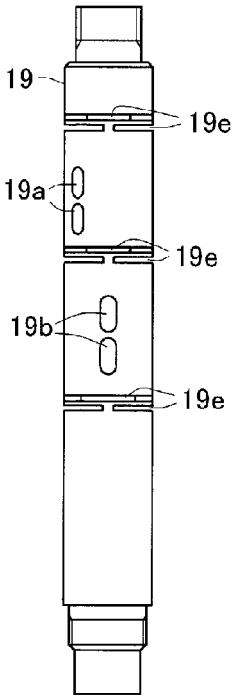
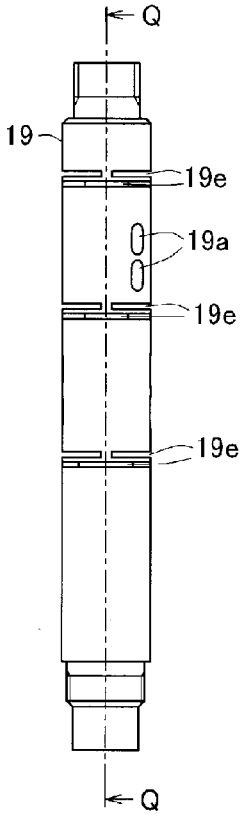
FIG.7D
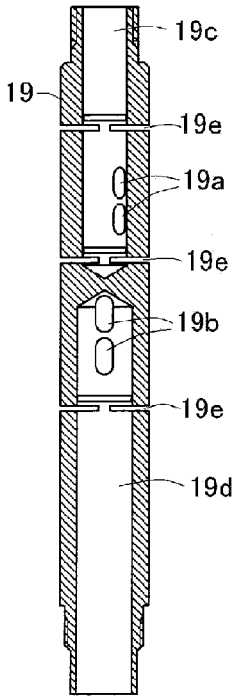
SECTION Q-Q

SECTION S-S

SECTION R-R

FIG.9A

| ROTATIONAL ANGLE OF OUTPUT SHAFT | FIRST PISTON | SECOND PISTON | THIRD PISTON | FOURTH PISTON |
|---|---|---|---|---|
| 0° | SWITCHING (COMPRESSION →EXPLOSION) | EXHAUST | SWITCHING (INTAKE → COMPRESSION) | EXPLOSION |
| 90° | EXPLOSION | SWITCHING (EXHAUST → INTAKE) | COMPRESSION | SWITCHING (EXPLOSION →EXHAUST) |
| 180° | SWITCHING (EXPLOSION →EXHAUST) | INTAKE | SWITCHING (COMPRESSION →EXPLOSION) | EXHAUST |
| 270° | EXHAUST | SWITCHING (INTAKE → COMPRESSION) | EXPLOSION | SWITCHING (EXHAUST → INTAKE) |
| 360° | SWITCHING (EXHAUST → INTAKE) | COMPRESSION | SWITCHING (EXPLOSION →EXHAUST) | INTAKE |
| 450° | INTAKE | SWITCHING (COMPRESSION →EXPLOSION) | EXHAUST | SWITCHING (INTAKE → COMPRESSION) |
| 540° | SWITCHING (INTAKE → COMPRESSION) | EXPLOSION | SWITCHING (EXHAUST → INTAKE) | COMPRESSION |
| 630° | COMPRESSION | SWITCHING (EXPLOSION →EXHAUST) | INTAKE | SWITCHING (COMPRESSION →EXPLOSION) |

FIG.9B

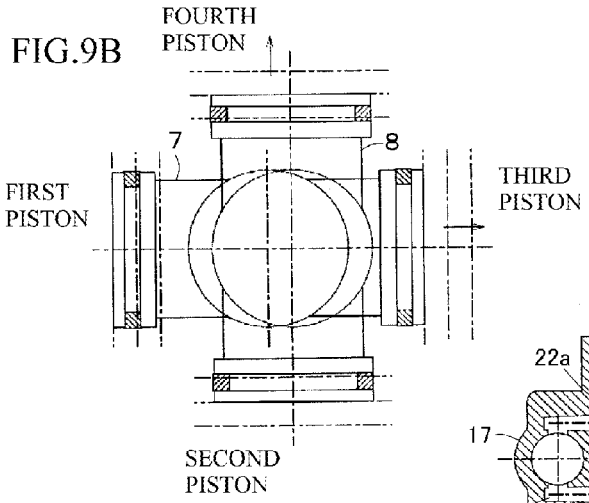

FIG.9C

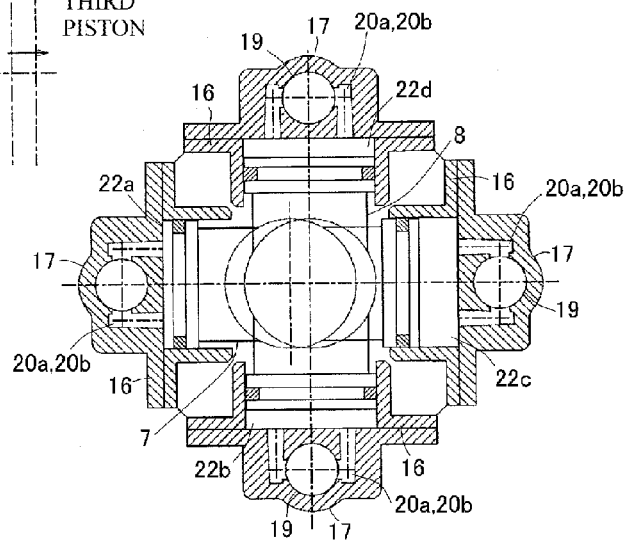

SECTION U-U

SECTION T-T

FIG.13
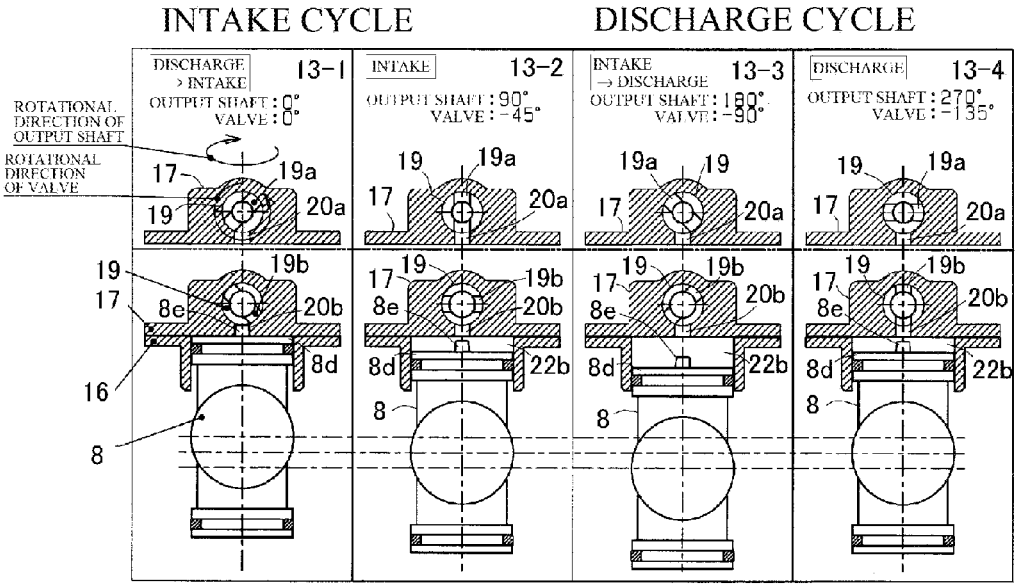
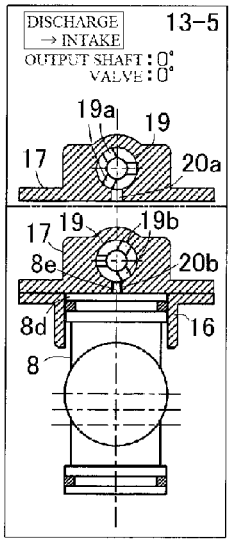

FLUID ROTARY MACHINE

FIELD OF TECHNOLOGY

The present invention relates to a fluid rotary machine which can be applied to an internal-combustion engine, e.g., gas turbine engine, four-cycle engine, a hydraulic machine, e.g., air engine, pressure motor, etc.

BACKGROUND TECHNOLOGY

In a fluid rotary machine, e.g., air feeding pump, liquid feeding pump, a reciprocally-driving mechanism in which a fluid is repeatedly sucked and discharged by a reciprocal movement of a piston unit linked with a crank shaft rotating along with rotation of a main shaft has been employed. On the other hand, the applicant of the present application has proposed a modified fluid rotary machine in which a fluid is repeatedly sucked and discharged by linearly reciprocally moving double-headed piston units, which are mutually intersected and attached to a crank shaft with an eccentric cam, on the basis of the hypocycloid principle. Rotary valves, each of which switches between a fluid sucking action and a fluid discharging action for each of cylinder chambers, are disposed coaxially with the main shaft, and pipes connected to intake ports and discharge ports of each of the cylinder chambers are summarized, so that number of external pipes can be reduced and an installation area of the machine can be reduced (see Patent Document 1).

PRIOR ART DOCUMENT

Patent Document

Patent Document 1: WO2012/17820

SUMMARY OF THE INVENTION

Problems to be Solved by the Invention

In the above described fluid rotary machine, communication channels for connecting the rotary valves to the cylinder chambers must be formed in a case body which accommodates the double-headed piston units. If the communication channels are long, they will become dead spaces when switching between the fluid sucking action and the fluid discharging action, so there is a possibility of lowering output efficiency due to the fluid enclosed in the communication channels. Namely, a ratio of the dead spaces corresponding to the communication channels, with respect to a volume of the cylinder chambers, can be reduced by increasing diameters of the cylinders and rotary valves, i.e., enlarging the fluid rotary machine, but volumes of the dead spaces must be increased.

An object of the present invention is to provide a fluid rotary machine in which dead spaces can be reduced as much as possible even if the machine is enlarged by arranging rotary valves directly behind cylinder chambers.

Means for Solving the Problems

To achieve the above described object, the present invention has following structures.

A fluid rotary machine in which first and second double-headed pistons intersecting within a case body move linearly back and forth within cylinders due to the hypocycloid principle along with rotation of shafts and in which intake and exhaust cycles are repeated in chambers, wherein cylinder heads for closing the cylinder chambers are each provided with rotary valves which are rotated by drive transmission from the shafts and which are provided with intake holes and discharge holes alternately communicated with the cylinder chambers via communication channels, and the rotary valves intersect longitudinal axis of the opposing pistons and are capable of rotating parallel with output axil lines.

With the above described structure, the cylinder heads for closing the cylinder chambers are each provided with the rotary valves which are rotated by the drive transmission from the shafts and which are provided with the intake holes and the discharge holes alternately communicated with the cylinder chambers via the communication channels, so that the communication channels between the cylinder chambers and the rotary valves can be highly shortened, dead spaces can be reduced as much as possible and output efficiency can be increased.

Preferably, the communication channels, which are formed in the cylinder heads so as to communicate each of the cylinder chambers with the intake holes and the discharge holes of the rotary valves, are symmetrically formed with respect to a surface including an axis of the cylinder and an axis of the rotary valve.

With the above described structure, in case that the fluid rotary machine is an internal-combustion engine, side pressure applied to the rotary valves can be cancelled in the communication channels symmetrically formed when the double-headed pistons are lifted to top dead centers in an explosion cycle of the cylinder chambers. Therefore, interfering smooth rotation of the rotary valves can be prevented.

Preferably, projecting sections, which can enter the communication channels so as to reduce dead spaces, are formed in piston head sections.

With this structure, a fluid can be released by making the projecting sections enter the communication channels, which communicate the cylinder chambers with the rotary valves, so that the fluid can be released, the dead spaces can be further reduced and the output efficiency can be increased.

In case that, the rotary valves are rotated by a speed reduction mechanism, which reduces revolution numbers of the shafts and transmits rotations thereof, influence of viscous resistance of an oil, which is caused along with rotation of the rotary valves, can be reduce, and loss of output with respect to input can be reduced, so that the output efficiency can be improved.

Effects of the Invention

By employing the fluid rotary machine of the present invention, the fluid rotary machine, in which the dead spaces can be reduced as much as possible even if the machine is enlarged by arranging the rotary valves directly behind the cylinder chambers, can be provided.

BRIEF DESCRIPTION OF THE DRAWINGS

FIGS. 7A-7E are a front view, a plan view, a right side view, a vertical sectional view taken along a line Q-Q and a perspective view of a rotary valve.

FIGS. 9A-9C are a table which shows switching timing of the rotary valves for engine, an explanation view in which the first and second piston units are replaced with first to fourth pistons for easy explanation, and a sectional view of combustion chambers formed by the first to fourth pistons.

FIG. 13 It includes explanation views of the rotary valve showing relationships between open-close actions of the rotary valve which is used for the turbine and which has the cylinder head section of FIGS. 12A-12G, the sucking-discharging cycles and speed reduction ratios.

EMBODIMENTS OF THE INVENTION

Figures 1A, 1B, 1C, 1D, 1E, 1F, 1G:
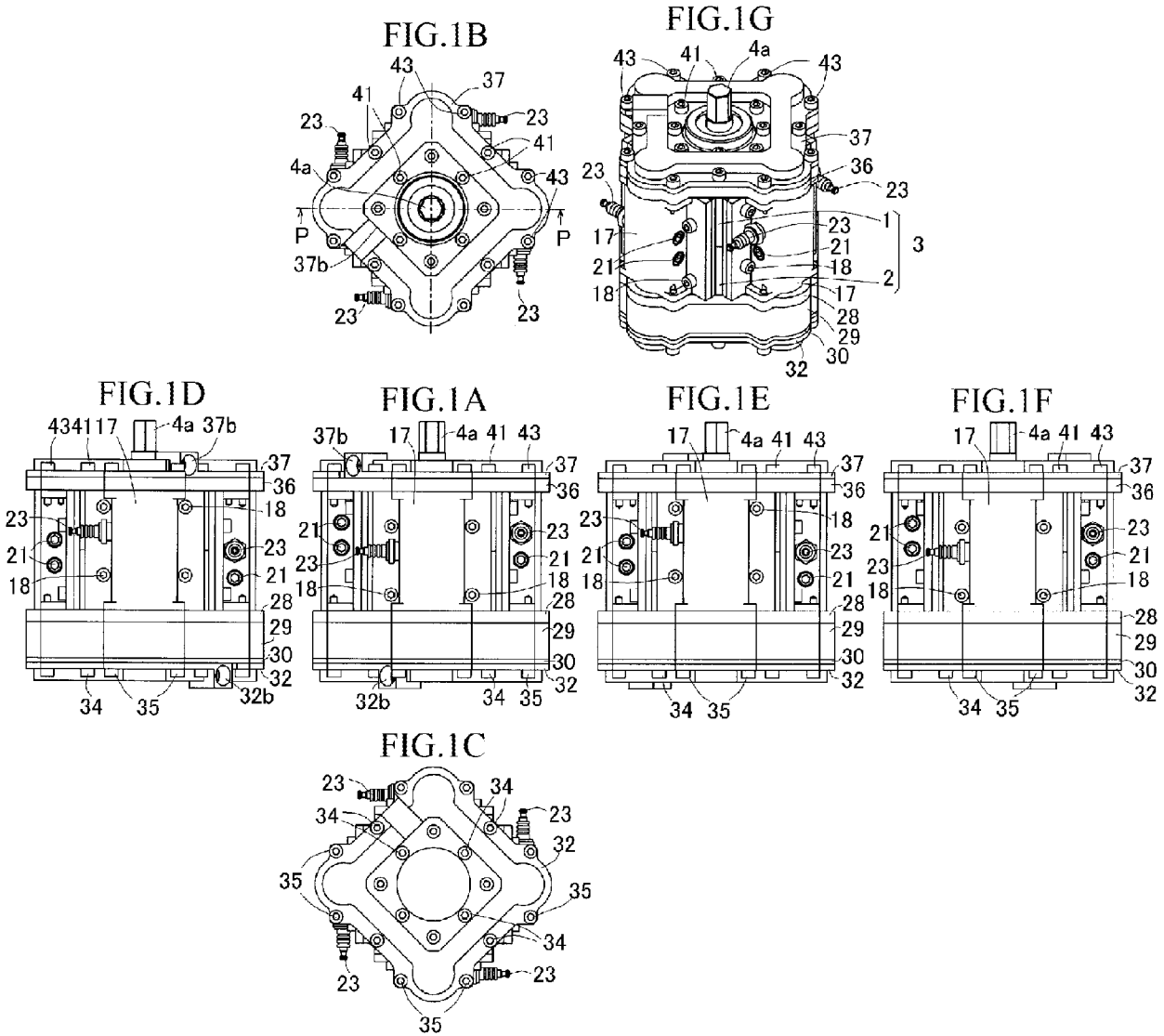
FIGS. 1A-1G are a front view, a plan view, a bottom view, a left side view, a right side view, a rear view and a perspective view of a four-cycle engine.

Preferred embodiments of the present invention will now be described in detail with reference to the accompanying drawings. Firstly, an example of the fluid rotary machine, e.g., four-cycle engine, turbine, will be explained with reference to FIGS. 1A-1G, 2-6, 7A-7E, 8A-8G, 9A-9C, 10, 11, 12A-12G and 13. The four-cycle engine may be an ordinary ignition gasoline engine, a four-cycle diesel engine, an air engine, etc. Note that, other mechanisms or units having no relevance to the characteristic points of the engine, e.g., fuel injector, gas-liquid mixer (carburetor), muffler, heat radiator (cooling fins, cooling unit using a cooling liquid, cooling unit having a fan, etc.), lubrication unit (including engine oil), are not shown in the drawings.

As a premise, in the four-cycle engine to be explained below, a first crank shaft is rotated, about an output shaft (shaft), along a circle having a radius of r by rotating the shaft, and an eccentric cam, which is formed into a cylindrical shape, relatively rotates about the first crank shaft. At this time, double-headed piston units, which intersect with each other and which are attached to the eccentric cam, are linearly reciprocally moved in a radial direction of a concentric circle (a rolling circle) having a radius of 2r along a rotation track (a hypocycloid track) having a radius of r, which is centered at a second virtual crank shaft of the eccentric cam fitted to the first crank shaft, so the engine is operated on the basis of the above described principle.

In the following description, a virtual crank arm need not be an independent element, and a part which structurally acts as a crank arm is regarded as the virtual crank arm. Further, even if a crank arm is omitted, a mechanism acting as a crank arm is regarded as the virtual crank arm. A crank shaft whose rotational axis is virtually existed is regarded as a virtual crank shaft even if no mechanical crank shaft exists. A piston unit is a unit in which a seal cup, a seal cup holder and a sealing member, e.g., piston ring, are integrally attached to a piston head section of a piston.

Figure 2:
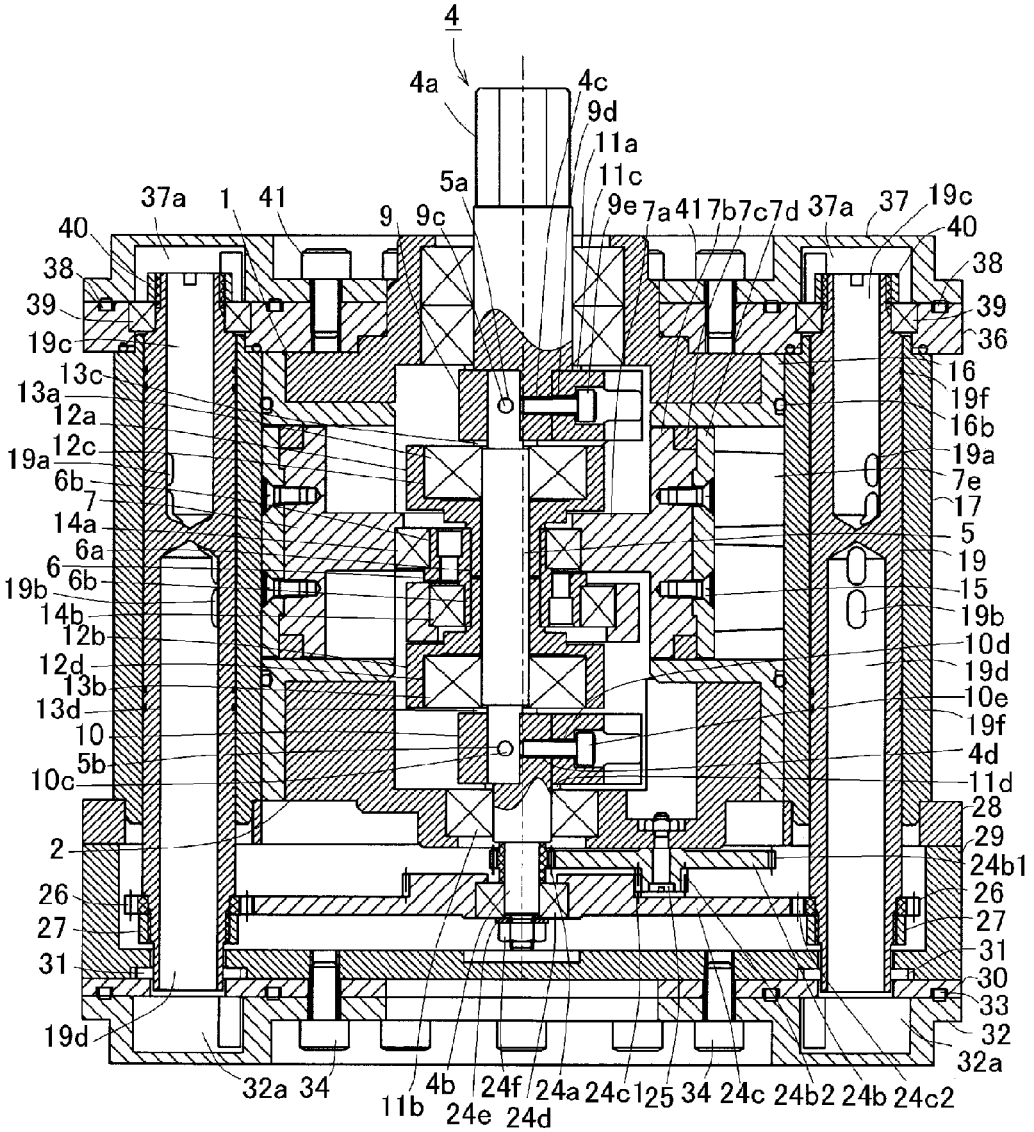
FIG. 2 It is a vertical sectional view of the engine taken along a line P-P of FIGS. 1A-1G.
Figure 5:
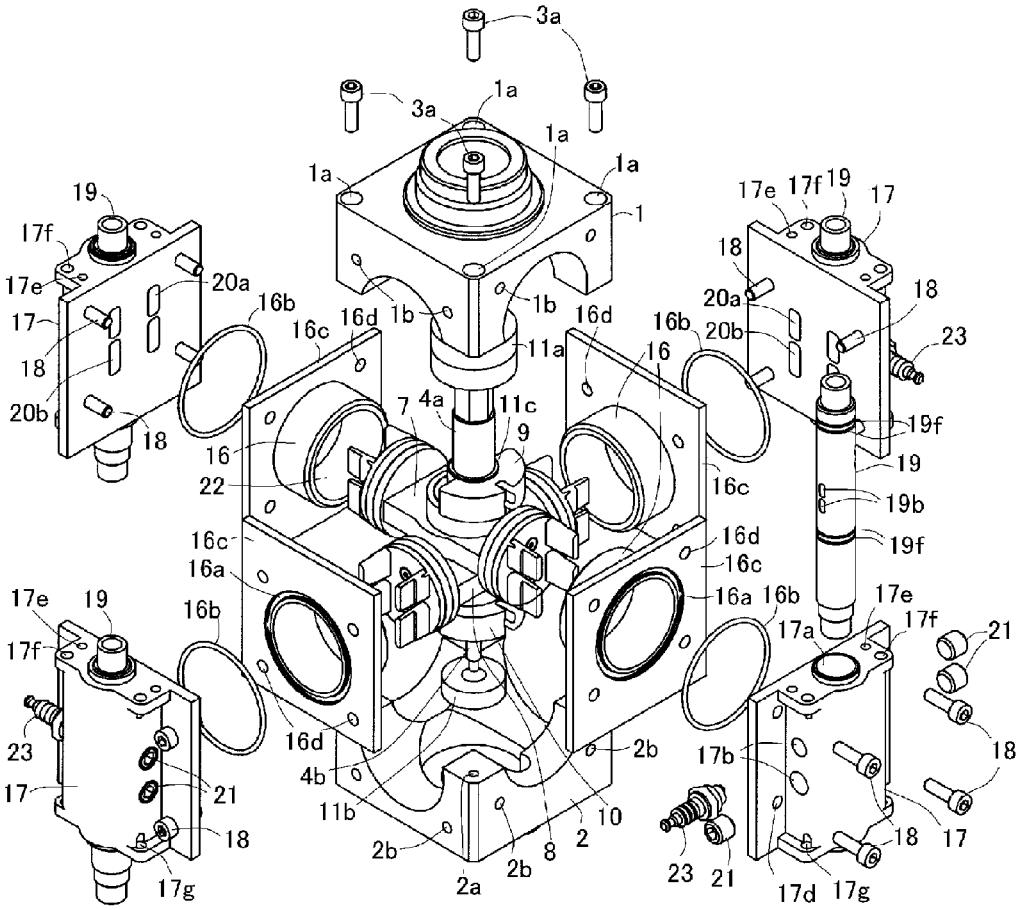
FIG. 5 It is an exploded perspective view of the fluid rotary machine.

In FIG. 2, a shaft 4 (constituted by output shafts 4*a* and 4*b*) is rotatably held by a case body 3 (see FIG. 1G), which is constituted by a first case body 1 and a second case body 2. As shown in FIG. 5, the first case body 1 and the second case body 2 are integrated by coinciding screw holes 1*a* and 2*a*, which are formed at four corners, with each other and screwing bolts 3*a* with the screw holes 1*a* and 2*a*. As shown in FIG. 2, a cylindrical eccentric cam 6, which is capable of relatively rotating about a first crank shaft 5, and a first double-headed piston unit 7 and a second double-headed piston unit 8, which are intersected with each other and which are attached to the eccentric cam 6 with bearings, are accommodated in the case body 3 and capable of relatively rotating. The structure will be concretely explained below.

Figure 4:
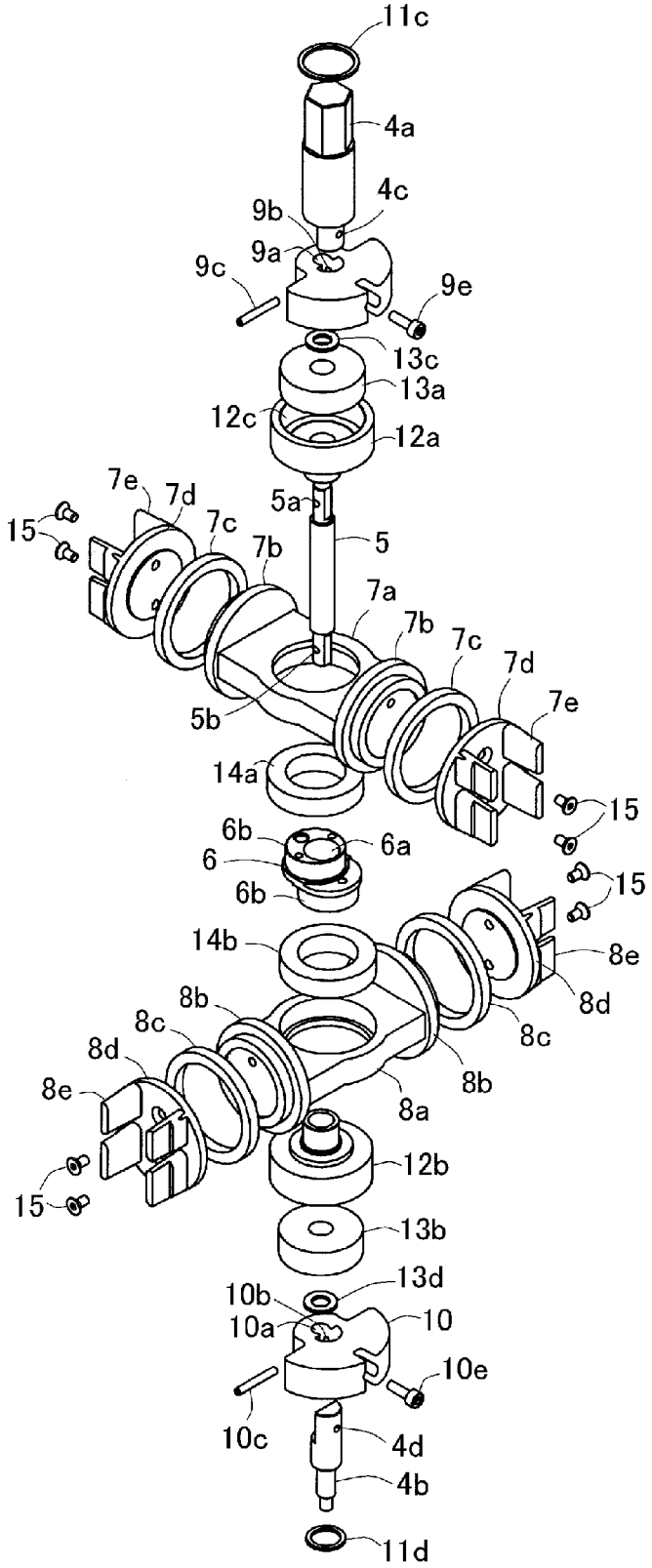
FIG. 4 It is an exploded perspective view of double-headed piston units.

In FIG. 2, the first crank shaft 5 is eccentrically attached with respect to an axis of the shaft 4 (constituted by the output shafts 4*a* and 4*b*). In the present embodiment, as shown in FIG. 4, the output shaft 4*a* and one end of the first crank shaft 5 are respectively fitted into a through-hole 9*a* of a first balance weight 9 from opposite sides. A pin hole 5*a*, which is formed in the one end of the first crank shaft 5, and a pin hole 9*b* (see FIG. 4) of the first balance weight 9 are coincided with each other, and then a pin 9*c* is fitted into the pin holes 9*b* and 5*a*. Then, a through-hole 9*d*, which is formed in a direction perpendicular to the pin 9*c*, and a screw hole 4*c* of the output shaft 4*a* are coincided with each other, and a bolt 9*e* is fitted thereinto until contacting the first crank shaft 5, so that the first crank shaft 5, the first balance weight 9 and the output shaft 4*a* can be integrated. Similarly, the output shaft 4*b* and the other end of the first crank shaft 5 are respectively fitted into a through-hole 10*a* of a second balance weight 10 from opposite sides. A pin hole 5*b*, which is formed in the other end of the first crank shaft 5, and a pin hole 10*b* (see FIG. 4) of the second balance weight 10 are coincided with each other, and then a pin 10*c* is fitted into the pin holes 10*b* and 5*b*. Then, a through-hole 10*d*, which is formed in a direction perpendicular to the pin 10*c*, and a screw hole 4*d* of the output shaft 4*b* are coincided with each other, and a bolt 10*e* is fitted thereinto until contacting the first crank shaft 5, so that the first crank shaft 5, the second balance weight 10 and the output shaft 4*b* can be integrated. Note that, the first and second balance weights 9 and 10 and the output shafts 4*a* and 4*b* may be integrally formed.

In FIG. 2, the output shaft 4*a* connected to the first balance weight 9 is rotatably held, in the first case body 1, by a first bearing 11*a*, and the output shaft 4*b* connected to the second balance weight 10 is rotatably held, in the second case body 2, by a first bearing 11*b*. The first and second balance weights 9 and 10 are attached around the output shafts 4*a* and 4*b* so as to produce a mass balance of rotatable members, including the first crank shaft 5 and the eccentric cam 6, around the output shafts 4*a* and 4*b*.

The eccentric cam 6, which is formed into a hollow cylindrical shape, has a cylindrical hole 6*a*, through which the first crank shaft 5 acting as a rotational axis is pierced, and eccentric cylindrical parts 6*b*, which are respectively extended from the axial both sides of the eccentric cam, are eccentrically disposed with respect to an axial line of the cylindrical hole 6*a*. The axial lines of the cylindrical parts 6*b* are coincided with second virtual crank shafts, which are eccentrically disposed with respect to the axial line of the first crank shaft 5. In the present embodiment, number of the intersecting first and second double-headed piston units 7 and 8 is two, so the second virtual crank shafts are formed at positions whose phases are respectively shifted by 180 degrees with respect to the first crank shaft 5 as the center. For example, the eccentric cam 6 is composed of a metal material, e.g., stainless steel, and integrally formed by MIM (Metal Injection Molding) manner.

A pair of bearing holders 12*a* and 12*b* are press-fitted into the cylindrical parts 6*a* of the eccentric cam 6 from the both sides or adhered to hole-walls of the cylindrical parts. The pair of bearing holders 12*a* and 12*b* respectively have bearing holding parts 12*c* and 12*d,* which are capable of respectively holding second bearings 13*a* and 13*b* whose diameter is greater than at least that of the cylindrical hole 6*a*. The bearing holders 12*a* and 12*b* are fitted into the cylindrical hole 6*a* from the both sides. The bearing holders 12*a* and 12*b* rotatably hold the eccentric cam 6 with the second bearings 13*a* and 13*b* and allow the same to relatively rotate with respect to the first crank shaft 5. A washer 13*c* is provided between the second bearing 13*a* and the first balance weight 9, and a washer 13*d* is provided between the second bearing 13*b* and the second balance weight 10. The first crank shaft 5 acts as a rotational center of the eccentric cam 6.

Third bearings 14*a* and 14*b* are respectively attached to outer peripheries of the pair of cylindrical parts 6*b,* which are eccentrically disposed with respect to the axial line of the cylindrical hole 6*a* and which are formed on the axial both sides. The first and second double-headed piston units 7 and 8 are overlapped and perpendicularly intersected (criss-crossed) with respect to the axial lines of the second virtual crank shafts, and the piston units are attached to the eccentric cam 6, with the third bearings 14*a* and 14*b,* in the intersecting state and capable of relatively rotating with respect to the eccentric cam.

In the above described structure, the eccentric cam 6 and the first and second double-headed piston units 7 and 8 can be compactly assembled, in the axial direction and the radial direction, around the first crank shaft 5 by making a length of second virtual crank arms respectively connecting the second virtual crank shafts (the axes of the cylindrical parts 6*b*) to the first crank shaft 5 equal to the rotational radius of r.

In the first and second double-headed piston units 7 and 8 shown in FIG. 2, piston head sections 7*b* and 8*b* (not shown) are respectively erected from both longitudinal ends of piston main body sections 7*a* and 8*a*. Piston rings 7*c* and 8*c* (not shown), which act as circular sealing members, and ring pressers 7*d* and 8*d* (see FIG. 4) are attached to the piston head sections 7*b* and 8*b* by bolts 15. The piston main body sections 7*a* and 8*a* are composed of a metal material (e.g., aluminum), and it is preferable to perform surface treatment (e.g., coating with an anodic oxide film) so as to improve corrosion resistance. The piston head sections 7*b* and 8*b* slide on inner wall surfaces of cylinders 16 (see FIG. 2), through the piston rings 7*c* and 8*c* covering outer circumferential surfaces, with keeping sealability. A plurality of projecting sections 7*e* and 8*e* described later are formed in the ring pressers 7*d* and 8*d* (see FIG. 4).

As shown in FIG. 5, the cylinders 16 are attached to side opening parts (four opening parts) of the case body 3, and opening parts of the cylinders are respectively closed by cylinder head sections 17. The cylinders 16 and the cylinder head sections 17 are fixed to the case body 3 by fixing bolts 18. Recessed grooves 16*a* are formed near edges of the opening parts of the cylinders 16. Circular seal rings 16*b* are respectively fitted in the recessed grooves 16*a*. The fixing bolts 18 are inserted into through-holes 17*d* of the cylinder heads 17 and screwed with screw holes lb and 2*b,* so that the cylinder head sections 17 and the cylinders 16 are respectively integrally attached to the four side surfaces of the case body 3.

In FIG. 5, rotary valves 19, which are rotated by drive transmission from the shaft 4 (the output shafts 4*a* and 4*b*), are provided in the cylinder head sections 17, which respectively close the opening parts of the cylinders 16, and the rotary valves intersect longitudinal axes of the double-headed piston units 7 and 8 and are capable of rotating parallel with the output shafts 4*a* and 4*b*. Valve through-holes 17*a,* which are parallel with the shaft 4 (the output shafts 4*a* and 4*b*), are formed in the cylinder head sections 17. The rotary valves 19, each of which is formed like a cylindrical body, are rotatably pierced through the valve through-holes 17*a*. Further, as shown in FIG. 7A, two intake holes 19*a* and two discharge holes 19*b* are formed in an outer circumferential surface of the rotary valve 19 and arranged in the longitudinal direction thereof. An intake channel 19*c* communicated with the intake holes 19*a* and a discharge channel 19*d* communicated with the discharge holes 19*b* are formed in the rotary valve 19 and partitioned from each other (see FIG. 7D).

In case of an engine, an explosion cycle (a burning process) is performed in cylinder chambers, so there is a possibility of deforming the rotary valves 19 due to temperature change and pressure change. If the rotary valves 19 are deformed, their smooth rotation are interfered. Thus, as shown in FIGS. 7A-7E, a plurality of pairs of arc-shaped slits 19*e,* whose arc angles are less than 180 degrees and whose phases are mutually shifted (e.g., shifted by 90 degrees), are formed in the rotary valve 19 and arranged in the longitudinal direction thereof. With this structure, even if thermal expansion difference occurs in the rotary valve 19 or side pressure is applied thereto, stress can be absorbed by the pairs of slits 19*e* arranged in the longitudinal direction, so that the rotation of the rotary valve 19 is not interfered. Further, oil grooves 19*f* (see FIGS. 2 and 3) for storing a lubrication oil may be circularly formed in the outer circumferential surface of the rotary valve 19 so as to smoothly rotate in the valve through-hole 17*a*. The oil grooves may be formed in an inner wall of the valve through-hole 17*a*.

Figures 8A, 8B, 8C, 8D, 8E, 8F, 8G:
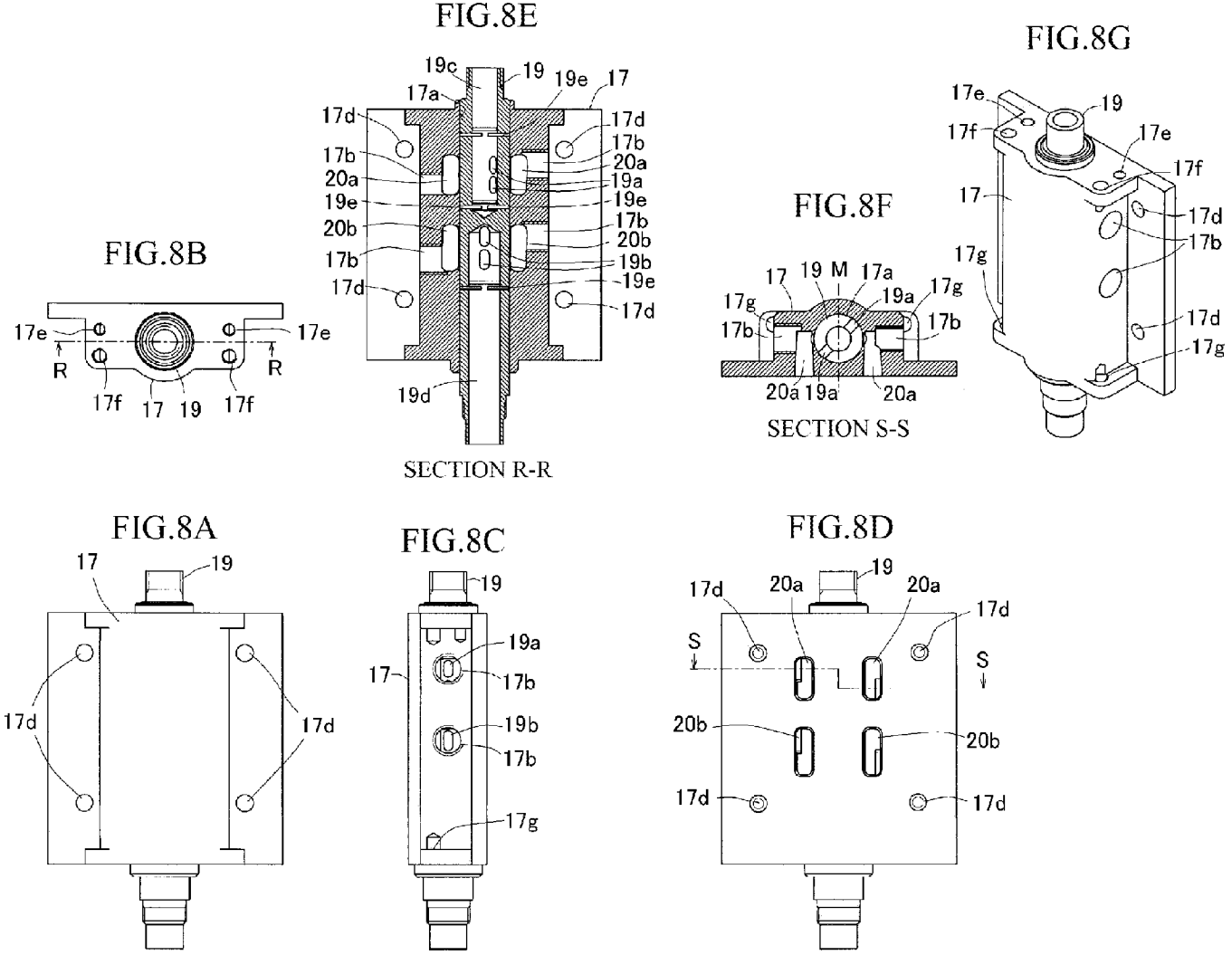
FIGS. 8A-8G are a front view, a plan view, a right side view, a rear view, a vertical sectional view taken along a line R-R, a sectional view taken along a line S-S and a perspective view of a cylinder head section.

In FIGS. 8A-8G, intake communication channels 20*a,* which communicate each of the cylinder chambers with the intake holes 19*a* of the rotary valve 19, and discharge communication channels 20*b,* which communicate each of the cylinder chambers with the discharge holes 19*b* of the rotary valve, are formed in a surface of the cylinder head section 17, which faces the opening part of the cylinder 16 (see FIGS. 8D and 8E). Shapes of the intake communication channels 20*a* and the discharge communication channels 20*b* are respectively symmetrically formed with respect to a reference surface M including the axis of the cylinder 16 and the axis of the rotary valve 19 perpendicularly intersecting the axis of the cylinder (see FIG. 8F). In case that the fluid rotary machine is an internal-combustion engine, a fluid pressure (gas pressure) is applied to the rotary valves 19 as side pressure when the first and second double-headed piston units 7 and 8 are lifted to top dead centers by performing the explosion cycle in burning chambers (cylinder chambers). The intake communication channels 20*a* and the discharge communication channels 20*b,* which are symmetrically formed with respect to the reference surface M, are capable of cancelling the side pressure. Therefore, the smooth rotations of the rotary valves 19 never interfered. Intersecting side holes, which communicate the valve through-holes 17*a* with the intake communication channels 20*a* and the discharge communication channels 20*b*, are closed by fitting screws 21 into holes 17*b* after forming the holes 17*b* in the cylinder head section 17 and forming the intake communication channels 20*a* or the discharge communication channels 20*b*. A part of the holes 17*b* will be used for attaching ignition plugs 23 (see FIGS. 1A and 1D-1G).

In FIG. 5, four burning chambers (cylinder chambers) 22 are enclosed by the first piston head sections 7*b*, the second piston sections 8*b*, the cylinders 16 and the cylinder head sections 17. In each of the cylinder head sections 17, the intake communication channels 20*a* and the discharge communication channels 20*b*, which are communicated with the burning chamber 22, are formed. The ignition plug (or a glow plug) 23 is provided to a center part of each of the cylinder head sections 17 and corresponds to each of the burning chambers 22. An explosion cycle is performed by igniting the ignition plug 23 when the burning chamber 22 is filled with combustion air (e.g., mixed gas, gas-liquid mixed gas).

Preferably, the projecting sections 7*e* and 8*e*, which can enter the intake communication channels 20*a* and the discharge communication channels 20*b* so as to reduce dead spaces, are formed in the ring pressers 7*d* and 8*d*, which are attached to the first piston head sections 7*b* and the second piston head sections 8*b*.

In FIG. 2, a speed reduction mechanism 24 for reducing a rotational speed and transmitting the reduced rotation to the output shaft 4*b* is provided to the rotary valve 19. The mechanism will be concretely explained.

a first gear 24*a* is integrated with the output shaft 4*a* and capable of rotating together. An idler gear 24*b* is engaged with the first gear 24*a*. The first idler gear 24*b* is attached by a holding pin 25 fitted to the second case body 2 and capable of being rotated about the holding pin 25. The first idler gear 24*b* is a stepped gear, and a first large diameter gear 24*b*1 is engaged with the first gear 24*a*. A first small diameter gear 24*b*2 is engaged with a second idler gear 24*c* provided to the output shaft 4*b*. The second idler gear 24*c* is a stepped gear, and a second small diameter gear 24*c*1 is engaged with the first small diameter gear 24*b*2. A second large diameter gear 24*c*2 of the second idler gear 24*c* is engaged with a valve gear 26, which is integrated with one end part (on a discharge side) of the rotary valve 19. The second idler gear 24*c* is rotatably attached to the output shaft 4*b* with a bearing 24*d*. The bearing 24*d* is attached by a nut 24*f*, which is screwed with the end of the output shaft 4*b* with a washer 24*e*, so that an axial position of the bearing can be defined and fixed there. The valve gear 26 is integrated by screwing a nut 27 with a screw section formed in an outer circumference of the rotary valve 19.

In FIG. 2, the speed reduction mechanism 24 is accommodated in a storage space, which is located in a lower part of the case body 3 and formed between the cylinder head section 17 and a base section 29 on the discharge side by a spacer 28. Through-holes 29*a*, through which one ends (on the discharge side) of the rotary valves 19 are pierced, are formed at four corners of the base section 29. The base section 29 is stacked on a shielding member 30. Through-holes 30*a* (see FIG. 6), through which the one ends (on the discharge side) of the rotary valves 19 are pierced, are formed at four corners of the shielding member 30. Note that, slide seal rings 31 are provided between the base section 29 on the discharge side and the shielding member 30, and the slide seal rings are respectively fitted on the outer circumferences of the rotary valves 19.

Figure 6:
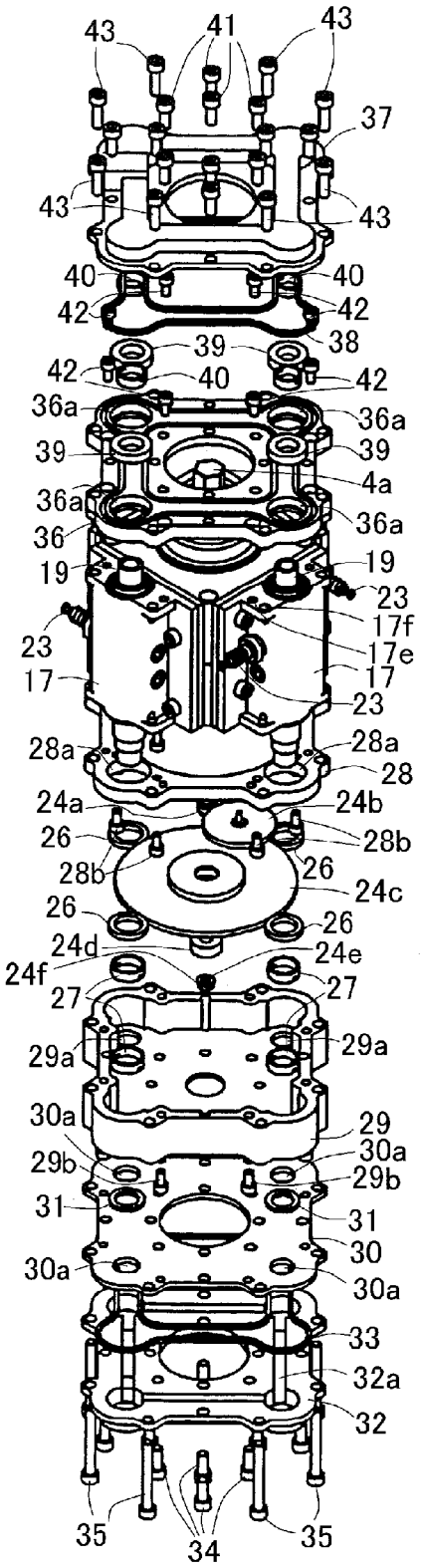
FIG. 6 It is an exploded perspective view of the four-cycle engine.

A lid 32 on an exhaust side is attached on the shielding member 30. An exhaust channel 32*a*, which is communicated with exhaust side ends (exhaust channels 19*d*) of the rotary valves 19, are formed in the lid 32. The exhaust channel 32*a* is circularly formed so as to communicate with the exhaust channels 19*d* of the rotary valves 19 provided to the four corners. The exhaust channel 32*a* is communicated with an exhaust port 32*b* of the lid 32 so as to exhaust air (see FIGS. 1A, 1C and 1D). Further, as shown in FIG. 6, the shielding member 30 is stacked on the lid 32 with a circular sealing member 33, which encloses the exhaust channel 32*a*, so that the exhaust channel 32*a* is air-tightly closed. As shown in FIG. 2, the shielding member 30 and the lid 32 are integrally attached to the base section 29 by bolts 34. The lid 32, the shielding member 30, the base section 29 and the spacer 28 are integrated by inserting fixing bolts 35 into their through-holes and screwing the fixing bolts with screw holes 17*g* of the cylinder head sections 17 (see FIGS. 8A-8G).

A base section 36 on an intake side and a lid 37 on the intake side are stacked and attached on the case body 3. Through-holes 36*a*, through which the other ends (on the intake side) of the rotary valves 19 are pierced, are formed at four corners of the base section 36. A sealing member 38 is fitted in a circular groove 36*b*. The other ends of the rotary valves 19 are inserted into the through-holes 36*a* and rotatably held by valve bearings 39. The valve bearings 39 are fitted on the outer circumferences of the rotary valves 19 and integrated by screwing nuts 40 with screw sections formed in the outer circumferences of the rotary valves 19. The valve bearings 39 are held, with clearances in the axial direction and the radial direction, by the base section 36 (the clearances are formed so as to receive axial loads of the rotary valves 19). An intake channel 37*a*, which is communicated with the intake side ends (intake channels 19*c*) of the rotary valves 19, are formed in the lid 37.

The intake channel 37*a* is circularly formed so as to communicate with the intake channels 19*c* of the rotary valves 19 provided to the four corners. The intake channel 37*a* is communicated with an intake port 37*b* of the lid 37 so as to suck air (see FIGS. 1A, 1B, 1D and 1G).

Further, as shown in FIG. 6, the lid 37 is stacked on the base section 36 with a circular sealing member 38, which encloses the intake channel 37*a*, so that the intake channel 37*a* is air-tightly closed. As shown in FIG. 2, the lid 37 is integrally attached to the base section 36 by bolts 41, eight of which are provided in an inner circumference part and four of which are provided in an outer circumference part. The base section 36 is integrally attached to the cylinder head sections 17 by screwing bolts 42 with screw holes 17*e* (see FIGS. 8A-8G) of the cylinder head sections. Further, the lid 37 and the base section 36 are integrated by inserting eight fixing bolts 43 (see FIG. 6), which are provided to four corners, into their through-holes and screwing the fixing bolts with screw holes 17*f* (see FIGS. 8A-8G) of the cylinder head sections 17.

In FIG. 2, by rotating the rotary valves 19 in a prescribed direction, the first gear 24*a* is rotated through the second idler gear 24*c* and the first idler gear 24*b*, and the output shaft 4*b* is rotated in the opposite direction at a reduced speed. A reduction ratio of the speed reduction mechanism 24 may be optionally set, but, in case of the fluid rotary machine for the engine shown in FIG. 2, the reduction ratio is set, for example, 1/4. In case of the fluid rotary machine for the turbine shown in FIG. 3, the reduction ratio is set, for example, 1/2.

Figure 3:
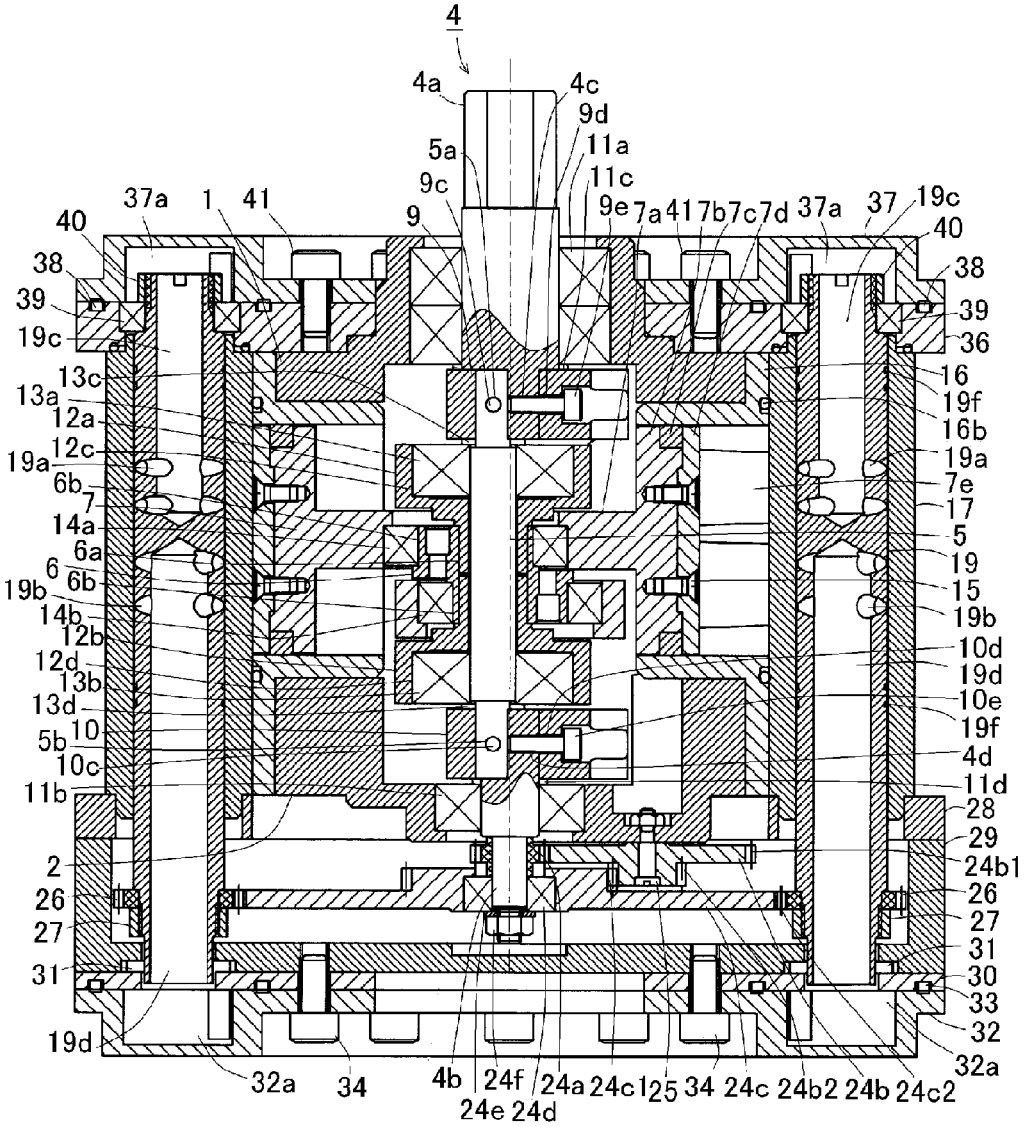
FIG. 3 It is a vertical sectional view of a turbine taken along the line P-P corresponding to FIG. 2.

Note that, in case of the fluid rotary machine for the turbine shown in FIG. 3, the structure of the rotary machine is similar to that of the fluid rotary machine shown in FIG. 2, so details of the structure are omitted, but timings of switching between the fluid sucking action and the fluid discharging action are different.

Successively, a structure of the four-cycle engine will be explained with reference to FIGS. 4-6.

Firstly, assembling the first and second double-headed piston units 7 and 8 to the eccentric cam 6 will be explained with reference to FIG. 4. The first crank shaft 5 is inserted into the cylindrical hole 6*a,* the third bearings 14*a* and 14*b* are respectively fitted to the outer circumferences of the eccentric cylindrical parts 6*b,* and then the first and second double-headed piston units 7 and 8 are respectively fitted to the outer circumferences of the third bearings. In the first and second double-headed piston units 7 and 8, the piston rings 7*c* and 8*c* are fitted to the outer circumferences of the piston head sections 7*b* and 8*b,* which are provided to both ends of the piston main body sections 7*a* and 8*a,* and the ring pressers 7*d* and 8*d* having the projecting sections 7*e* and 8*e* are integrally attached by the bolts 15.

After attaching the first and second double-headed piston units 7 and 8 to the eccentric cam 6, the bearing holders 12*a* and 12*b,* which hold the second bearings 13*a* and 13*b,* are press-fitted into the bearing holders 12*c* and 12*d* from the axial both sides of the first crank shaft 5. The first and second balance weights 9 and 10 and the output shafts 4*a* and 4*b* are integrally attached to the both ends of the first crank shaft 5 with the washers 13*c* and 13*d*. Further, washers 11*c* and 11*d* are fitted to the output shafts 4*a* and 4*b* (see FIG. 4).

As shown in FIG. 5, a rotational body, in which the first and second double-headed piston units 7 and 8 are attached to the eccentric cam 6, is accommodated in the first case body 1 and the second case body 2. The first bearing 11*a* is fitted to the output shaft 4*a* with the washer 11*c* and rotatably held by the first case body 1. Further, the first bearing 11*b* is fitted to the output shaft 4*b* with the washer 11*d* and rotatably held by the second case body 2. The cylinders 16 are respectively clamped in the four side surfaces of the first and second case bodies 1 and 2, the piston head sections 7*b* and 8*b* are inserted thereinto, and the cylinder head sections 17 are respectively attached to the cylinders 6. The screwing bolts 3*a* are inserted from the four corners of the first case body 1 and screwed with the second case body 2, so that the rotary cylinder unit is accommodated in the case body 3.

In FIG. 6, an intake unit is attached to the output shaft 4*a* of the rotary cylinder unit, and an exhaust unit is attached to the output shaft 4*b* thereof.

The intake unit is attached to the first case body 1. The base section 36 is integrally attached to the first case body 1 by screwing the screwing bolts 42 with the screw holes 17*e* of the cylinder head sections 17. The valve bearings 39 are respectively fitted to the outer circumferences of the four rotary valves 19, and the valve bearings are respectively inserted into the valve through-holes 17*a* of the cylinder head sections 17 by screwing the nuts 40. The lid 37 is integrally attached to the base section 36 by the bolts 41. Further, they are integrally attached to the cylinder head sections 17 by inserting the fixing bolts 43 into through-holes, which passing through the lid 37 and the base section 36, and screwing the same with the screw holes 17*f*.

The exhaust unit is attached to the second case body 2. The speed reduction mechanism 24 is attached to the second case body 2. The first gear 24*a* is attached to the output shaft 4*b,* and the first idler gear 24*b,* which is engaged with the first gear, is attached by the holding pin 25. The second idler gear 24*c* is attached to the output shaft 4*b* with the bearing 24*d,* the nut 24*f* is screwed with the washer 24*e,* and the four valve gears 26, which are engaged with the second idler gear, are respectively fitted to the outer circumferences of the rotary valves 19 and fixed by the nuts 27. Actually, the speed reduction mechanism 24 is attached with confirming origin positions, i.e., the top dead centers of the pistons.

Further, the exhaust unit is attached to cover the speed reduction mechanism 24. The spacer 28 is attached by inserting the rotary valves 19 into four through-holes 28*a,* matching positions of the cylinder head sections 17 and screw holes not shown, and screwing bolts 28*b*. The base section 29 is integrally attached to the spacer 28 by bolts 29*b* (see FIG. 6). Further, the shielding member 30 and the lid 32 are integrally attached to the base section 29 by the bolts 34. Finally, the spacer 28, the base section 29, the shielding member 30 and the lid 32 are integrally attached to the second case body 2 (the cylinder head sections 17), in the stacked state, by inserting the fixing bolts 35 into the through-holes and screwing the same with the screw holes 17*g* of the cylinder head sections 17.

In the four-cycle engine having the above described structure, the rotary valves 19, which are respectively provided to the cylinder head sections 17 located at the four positions of the case body 3 to close the cylinder chambers (the burning chambers 22), are respectively rotated along with the rotation of the shaft (the output shaft) 4, an intake cycle is repeatedly performed with communicating the intake holes 19*a* of the rotary valves 19 with the burning chambers 22 within a range where the intake holes overlap the intake channel 19*c,* and an exhaust cycle is repeatedly performed with communicating the discharge holes 19*b* of the rotary valves 19 with the burning chambers 22 within a range where the discharge holes overlap the discharge channel 19*d*. Therefore, the intake cycle and the exhaust cycle can be performed by the small and simple valve mechanism in which the structural parts of the engine are rotated about the output shaft 4, further, reducing vibration and noise can be realized by the rotation based on the hypocycloid principle, so that the four-cycle engine having high output efficiency can be provided. Further, in comparison with the conventional reciprocating engine, mechanical loss caused by reciprocating movements of the piston head sections 7*b* and 8*b* can be prevented in the first and second double-headed piston units 7 and 8 by reducing rotational vibration, so that energy conversion efficiency can be improved and a vibrationproof structure can be simplified.

An example of the burning process of the four-cycle engine will be explained with reference to FIGS. 9A-9C. FIG. 9A shows the burning process (i.e., intake, compression, explosion and exhaust cycles) corresponding to positions of the first to fourth pistons in the four burning chambers 22*a*-22*d*. FIG. 9B is an explanation view in which the first and second double-headed piston units 7 and 8, which are intersected with each other, are replaced with the first to fourth pistons. In FIG. 9B, the first piston is in the middle of moving from a top dead center to an intermediate position, and the third piston is in the middle of moving from a bottom dead center to an intermediate position. The second piston is in the middle of moving from an intermediate position to a bottom dead center, and the fourth piston is in the middle of moving from an intermediate position to a top dead center. FIG. 9C is a sectional view showing the burning chambers 22*a*-22*d* formed by the first to fourth pistons.

Figure 10:
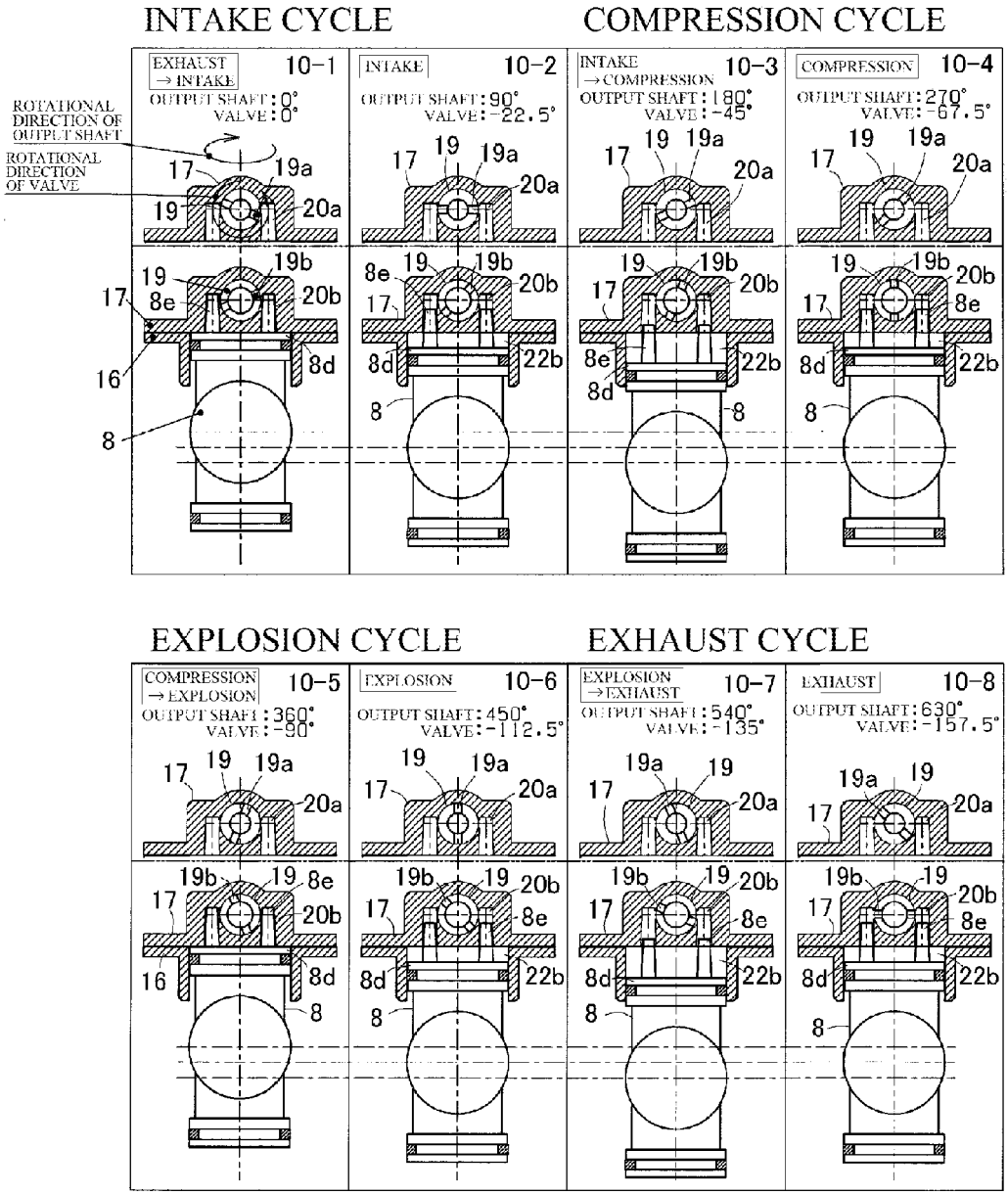
FIG. 10 It includes explanation views showing relationships between open-close actions of the rotary valve for the engine and positions of the piston.

In FIG. 9A, the first to fourth pistons correspond to the first and second double-headed piston units 7 and 8 which are intersected with each other, and they are named to easily explain the burning process in the four burning chambers 22*a*-22*d* shown in FIG. 9C. Further, as shown in FIG. 10, each of the intake holes 19*a* and each of the discharge holes 19*b* are oppositely formed with a phase difference of 180 degrees around the rotary valve 19, and the intake holes 19*a* and the discharge holes 19*b*, which are arranged in the longitudinal direction, are shifted, in the circumferential direction, with a phase difference of 45 degrees.

In FIG. 9A, a rotational angle of the output shaft 4 is zero (i.e., a rotational angle of the rotary valves 29 is zero). In this state, the burning process in the first burning chamber 22*a* is being switched from the compression cycle to the explosion cycle, the exhaust cycle is performed in the second burning chamber 22*b*, the burning process in the third burning chamber 22*c* is being switched from the intake cycle to the compression cycle, and the explosion cycle is performed in the fourth burning chamber 22*d*.

When the rotational angle of the output shaft 4 reaches 90 degrees, the explosion cycle is performed in the first burning chamber 22*a*, the burning process in the second burning chamber 22*b* is being switched from the exhaust cycle to the intake cycle, the compression cycle is performed in the third burning chamber 22*c*, and the burning process in the fourth burning chamber 22*d* is being switched from the explosion cycle to the exhaust cycle.

When the rotational angle of the output shaft 4 reaches 180 degrees, the burning process in the first burning chamber 22*a* is being switched from the explosion cycle to the exhaust cycle, the intake cycle is performed in the second burning chamber 22*b*, the burning process in the third burning chamber 22*c* is being switched from the compression cycle to the explosion cycle, and the exhaust cycle is performed in the fourth burning chamber 22*d*.

When the rotational angle of the output shaft 4 reaches 180 degrees, the burning process in the first burning chamber 22*a* is being switched from the explosion cycle to the exhaust cycle, the intake cycle is performed in the second burning chamber 22*b*, the burning process in the third burning chamber 22*c* is being switched from the compression cycle to the explosion cycle, and the exhaust cycle is performed in the fourth burning chamber 22*d*.

When the rotational angle of the output shaft 4 reaches 270 degrees, the exhaust cycle is performed in the first burning chamber 22*a*, the burning process in the second burning chamber 22*b* is being switched from the intake cycle to the compression cycle, the explosion cycle is performed in the third burning chamber 22*c*, and the burning process in the fourth burning chamber 22*d* is being switched from the exhaust cycle to the intake cycle.

When the rotational angle of the output shaft 4 reaches 360 degrees, the burning process in the first burning chamber 22*a* is being switched from the exhaust cycle to the intake cycle, the compression cycle is performed in the second burning chamber 22*b*, the burning process in the third burning chamber 22*c* is being switched from the explosion cycle to the exhaust cycle, and the intake cycle is performed in the fourth burning chamber 22*d*.

When the rotational angle of the output shaft 4 reaches 450 degrees, the intake cycle is performed in the first burning chamber 22*a*, the burning process in the second burning chamber 22*b* is being switched from the compression cycle to the explosion cycle, the exhaust cycle is performed in the third burning chamber 22*c*, and the burning process in the fourth burning chamber 22*d* is being switched from the intake cycle to the compression cycle.

When the rotational angle of the output shaft 4 reaches 540 degrees, the burning process in the first burning chamber 22*a* is being switched from the intake cycle to the compression cycle, the explosion cycle is performed in the second burning chamber 22*b*, the burning process in the third burning chamber 22*c* is being switched from the exhaust cycle to the intake cycle, and the compression cycle is performed in the fourth burning chamber 22*d*.

When the rotational angle of the output shaft 4 reaches 630 degrees, the compression cycle is performed in the first burning chamber 22*a*, the burning process in the second burning chamber 22*b* is being switched from the explosion cycle to the exhaust cycle, the intake cycle is performed in the third burning chamber 22*c*, and the burning process in the fourth burning chamber 22*d* is being switched from the compression cycle to the explosion cycle.

Then, when the rotational angle of the output shaft 4 reaches 720 degrees (i.e., rotating two times), the rotational angle returns to zero. Then, the above described process is repeatedly performed.

FIGS. 10-1 to 10-8 are explanation views showing relationships between open-close actions of the rotary valve for the engine and positions of the piston. In FIGS. 10-1 to 10-8, the output shaft is rotated from 0 to 630 degrees (i.e., the rotary valve is rotated from 0 to −157.5 degrees), and the shaft shown in each of the drawings is rotated 90 degrees (i.e., the valve is rotated 22.5 degrees). The rotational direction of the rotary valve 19 is an opposite direction (e.g., counterclockwise direction (the angle is indicated with the minus-sign)) of that of the shaft 4 (e.g., clockwise direction). Any of the pistons may be used for explanation, but, in relation with FIG. 9A, the positional relationships of the second piston (i.e., one side of the second double-headed piston unit 8) are shown. The intake communication channel 20*a* formed in the cylinder head section 17 is shown in upper parts, and the discharge communication channel 20*b* is shown in lower parts. Note that, in case of the engine, the speed reduction mechanism 24 reduces a rotational speed of the rotary valve 19 to 1/4 of the output shaft 4.

FIGS. 10-1 and 10-2 show the intake cycle. In FIG. 10-1, the rotational angle of the output shaft is zero, and the rotational angle of the rotary valve 19 is zero. The intake holes 19*a* of the rotary valve 19 are not communicated with the intake communication channel 20*a*, and the discharge holes 19*b* are not communicated with the discharge communication channel 20*b*. The second piston is located at the top dead center, and the burning process is being switched from the exhaust cycle to the intake cycle.

The projecting section 8*e* formed in the ring presser 8*d* of the second piston enters the discharge communication channel 20*b* so as to minimize a dead space.

In FIG. 10-2, the rotational angle of the output shaft is 90 degrees, and the rotational angle of the rotary valve 19 is −22.5 degrees. The intake holes 19*a* of the rotary valve 19 are communicated with the intake communication channel 20*a*, and the discharge holes 19*b* are not communicated with the discharge communication channel 20*b*. The second piston is moved from the top dead center to the bottom dead center, and the intake cycle is performed in the burning chamber 22*b* through the intake holes 19*a* and the intake communication channel 20*a*. With the movement of the second piston, the projecting section 8*e* of the ring presser 8*d* starts to move away from the discharge communication channel 20*b*.

FIGS. 10-3 and 10-4 show the compression cycle. In FIG. 10-3, the rotational angle of the output shaft is 180 degrees, and the rotational angle of the rotary valve 19 is −45 degrees. The intake holes 19*a* of the rotary valve 19 are not communicated with the intake communication channel 20*a*, and the discharge holes 19*b* are not communicated with the discharge communication channel 20*b*. The second piston is located at the bottom dead center, and the burning process is being switched from the intake cycle to the compression cycle. The projecting section 8*e* of the ring presser 8*d* of the second piston is nearly evacuated from the discharge communication channel 20*b*.

In FIG. 10-4, the rotational angle of the output shaft is 270 degrees, and the rotational angle of the rotary valve 19 is −67.5 degrees. The intake holes 19*a* of the rotary valve 19 are not communicated with the intake communication channel 20*a*, and the discharge holes 19*b* are not communicated with the discharge communication channel 20*b*. The second piston is moved from the bottom dead center to an intermediate position, and the gas (e.g., gas-liquid mixed gas) is compressed in the burning chamber 22*b*. With the movement of the second piston, the projecting section 8*e* of the ring presser 8*d* of the second piston starts to enter the discharge communication channel 20*b*.

FIGS. 10-5 and 10-6 show the explosion cycle. In FIG. 10-5, the rotational angle of the output shaft is 360 degrees, and the rotational angle of the rotary valve 19 is −90 degrees. The intake holes 19*a* of the rotary valve 19 are not communicated with the intake communication channel 20*a*, and the discharge holes 19*b* are not communicated with the discharge communication channel 20*b*. The second piston is located at the top dead center, and the burning process is being switched from the compression cycle to the explosion cycle. The projecting section 8*e* of the ring presser 8*d* of the second piston is in the discharge communication channel 20*b*.

In FIG. 10-6, the rotational angle of the output shaft is 450 degrees, and the rotational angle of the rotary valve 19 is −112.5 degrees. The intake holes 19*a* of the rotary valve 19 are not communicated with the intake communication channel 20*a*, and the discharge holes 19*b* are not communicated with the discharge communication channel 20*b*. The compressed gas in the burning chamber 22*b* is exploded by igniting the ignition plug 23 (see FIGS. 1A-1G), so the second piston is moved from the top dead center to the bottom dead center. At this moment, side pressure generated by the explosion is applied to the rotary valve 19, but the intake communication channel 20*a* and the discharge communication channel 20*b* are respectively symmetrically formed with respect to the surface including the axis of the cylinder 16 and the axis of the rotary valve 19 which perpendicularly intersects the axis of the cylinder, so that the side pressure can be cancelled and the smooth rotation of the rotary valve 19 can be secured. The projecting section 8*e* of the ring presser 8*d* of the second piston is evacuated from the discharge communication channel 20*b*.

FIGS. 10-7 and 10-8 show the exhaust cycle. In FIG. 10-7, the rotational angle of the output shaft is 540 degrees, and the rotational angle of the rotary valve 19 is −135 degrees. The intake holes 19*a* of the rotary valve 19 are not communicated with the intake communication channel 20*a*, and the discharge holes 19*b* are not communicated with the discharge communication channel 20*b*. The second piston is located at the bottom dead center, and the burning process is being switched from the explosion cycle to the exhaust cycle. The projecting section 8*e* of the ring presser 8*d* of the second piston is nearly evacuated from the discharge communication channel 20*b*.

In FIG. 10-8, the rotational angle of the output shaft is 630 degrees, and the rotational angle of the rotary valve 19 is −157.5 degrees. The intake holes 19*a* of the rotary valve 19 are not communicated with the intake communication channel 20*a*, and the discharge holes 19*b* are communicated with the discharge communication channel 20*b*. The second piston is moved from the bottom dead center to the top dead center, so the burning gas exhausted from the burning chamber 22*b* via the discharge communication channel 20*b* and the discharge holes 19*b*. The projecting section 8*e* of the ring presser 8*d* of the second piston enters the discharge communication channel 20*b*.

When the rotational angle of the output shaft is 720 degrees, and the rotational angle of the rotary valve 19 is −180 degrees, the state of the engine is returned to the state shown in FIG. 10-1. Then, the above described process is repeatedly performed.

As described above, the communication channels between the burning chambers 22 and the rotary valves 19 are very short, and the projecting sections 8*e*, which enter the intake communication channels 20*a* and the discharge communication channels 20*b* so as to reduce dead spaces, are formed in the ring pressers 8*d*, so that a fluid can be released when switching the burning process, i.e., the intake cycle, the compression cycle, the explosion cycle and the exhaust cycle, and the dead spaces can be highly reduced.

Figure 11:
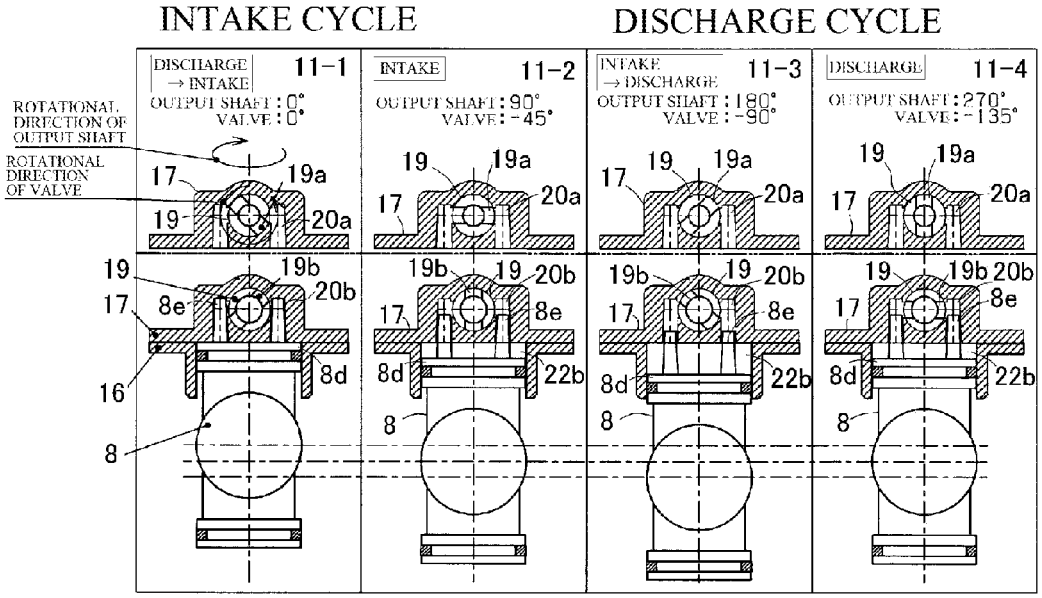
FIG. 11 It includes explanation views showing relationships between open-close actions of the rotary valve for a turbine and sucking-discharging cycles.

Successively, FIGS. 11-1 to 11-4 are explanation views showing relationships between open-close actions of the rotary valve for the turbine and positions of the piston. In FIGS. 11-1 to 11-4, the output shaft is rotated from 0 to 270 degrees (i.e., the rotary valve is rotated from 0 to −135 degrees), and the shaft shown in each of the drawings is rotated 90 degrees (i.e., the valve is rotated 45 degrees). The rotational direction of the rotary valve 19 is an opposite direction (e.g., counterclockwise direction (the angle is indicated with the minus-sign)) of that of the shaft 4 (e.g., clockwise direction). Each of the intake holes 19*a* are oppositely formed with a phase difference of 180 degrees around the rotary valve 19, and each of the discharge holes 19*b* are also oppositely formed with a phase difference of 180 degrees around the rotary valve 19. The intake holes 19*a* and the discharge holes 19*b*, which are arranged in the longitudinal direction of the rotary valve 19, are shifted, in the circumferential direction, with a phase difference of 90 degrees. The intake communication channel 20*a* formed in the cylinder head section 17 is shown in upper parts, and the discharge communication channel 20*b* is shown in lower parts. Any of the pistons may be used for explanation, but the positional relationships of the second piston (i.e., the one side of the second double-headed piston unit 8) are shown as well as the above described engine. In FIG. 10, the inside of the cylinder 16 is explained as the burning chamber, but, in FIG. 11, it will be explained as a cylinder chamber 22. Note that, the speed reduction mechanism 24 reduces a rotational speed of the rotary valve 19 to 1/2 of the output shaft 4.

FIGS. 11-1 and 11-2 show the intake cycle. In FIG. 11-1, the rotational angle of the output shaft is zero, and the rotational angle of the rotary valve 19 is zero. The intake holes 19*a* of the rotary valve 19 are not communicated with the intake communication channel 20*a*, and the discharge holes 19*b* are not communicated with the discharge communication channel 20*b*. The second piston is located at the top dead center, and the operation cycle is being switched from the exhaust cycle to the intake cycle.

The projecting section 8*e* formed in the ring presser 8*d* of the second piston enters the discharge communication channel 20*b* so as to minimize the dead space.

In FIG. 11-2, the rotational angle of the output shaft is 90 degrees, and the rotational angle of the rotary valve 19 is −45 degrees. The intake holes 19*a* of the rotary valve 19 are communicated with the intake communication channel 20*a*, and the discharge holes 19*b* are not communicated with the discharge communication channel 20*b*. The second piston is moved from the top dead center to the bottom dead center, and the intake cycle is performed in the cylinder chamber 22 through the intake holes 19*a* and the intake communication channel 20*a*. With the movement of the second piston, the projecting section 8*e* formed in the ring presser 8*d* starts to evacuate from the discharge communication channel 20*b*.

FIGS. 11-3 and 11-4 show the discharge cycle. In FIG. 11-3, the rotational angle of the output shaft is 180 degrees, and the rotational angle of the rotary valve 19 is −90 degrees. The intake holes 19*a* of the rotary valve 19 are not communicated with the intake communication channel 20*a*, and the discharge holes 19*b* are not communicated with the discharge communication channel 20*b*. The second piston is located at the bottom dead center, and the operation cycle is being switched from the intake cycle to the discharge cycle. The projecting section 8*e* formed in the ring presser 8*d* of the second piston is nearly evacuated from the discharge communication channel 20*b*.

In FIG. 11-4, the rotational angle of the output shaft is 270 degrees, and the rotational angle of the rotary valve 19 is −135 degrees. The intake holes 19*a* of the rotary valve 19 are not communicated with the intake communication channel 20*a*, and the discharge holes 19*b* are communicated with the discharge communication channel 20*b*. The second piston is moved from the bottom dead center to the top dead center, so that the gas in the cylinder chamber 22 is discharged through the discharge communication channel 20*b* and the discharge holes 19*b*. The projecting section 8*e* formed in the ring presser 8*d* of the second piston enters the discharge communication channel 20*b*.

When the rotational angle of the output shaft is 360 degrees, and the rotational angle of the rotary valve 19 is −180 degrees, the state of the turbine is returned to the state shown in FIG. 11-1. Then, the above described process is repeatedly performed.

Another embodiment, in which the communication channels between the cylinder chambers 22 of the cylinder head sections 17 and the rotary valves 19 are modified, is shown in FIGS. 12A-12G. Each of the intake holes 19*a* are oppositely formed with a phase difference of 180 degrees around the rotary valve 19, and each of the discharge holes 19*b* are also oppositely formed with a phase difference of 180 degrees around the rotary valve 19. The intake holes 19*a* and the discharge holes 19*b*, which are arranged in the longitudinal direction, are shifted, in the circumferential direction of the rotary valve 19, with a phase difference of 90 degrees.

Figures 12A, 12B, 12C, 12D, 12E, 12F, 12G:
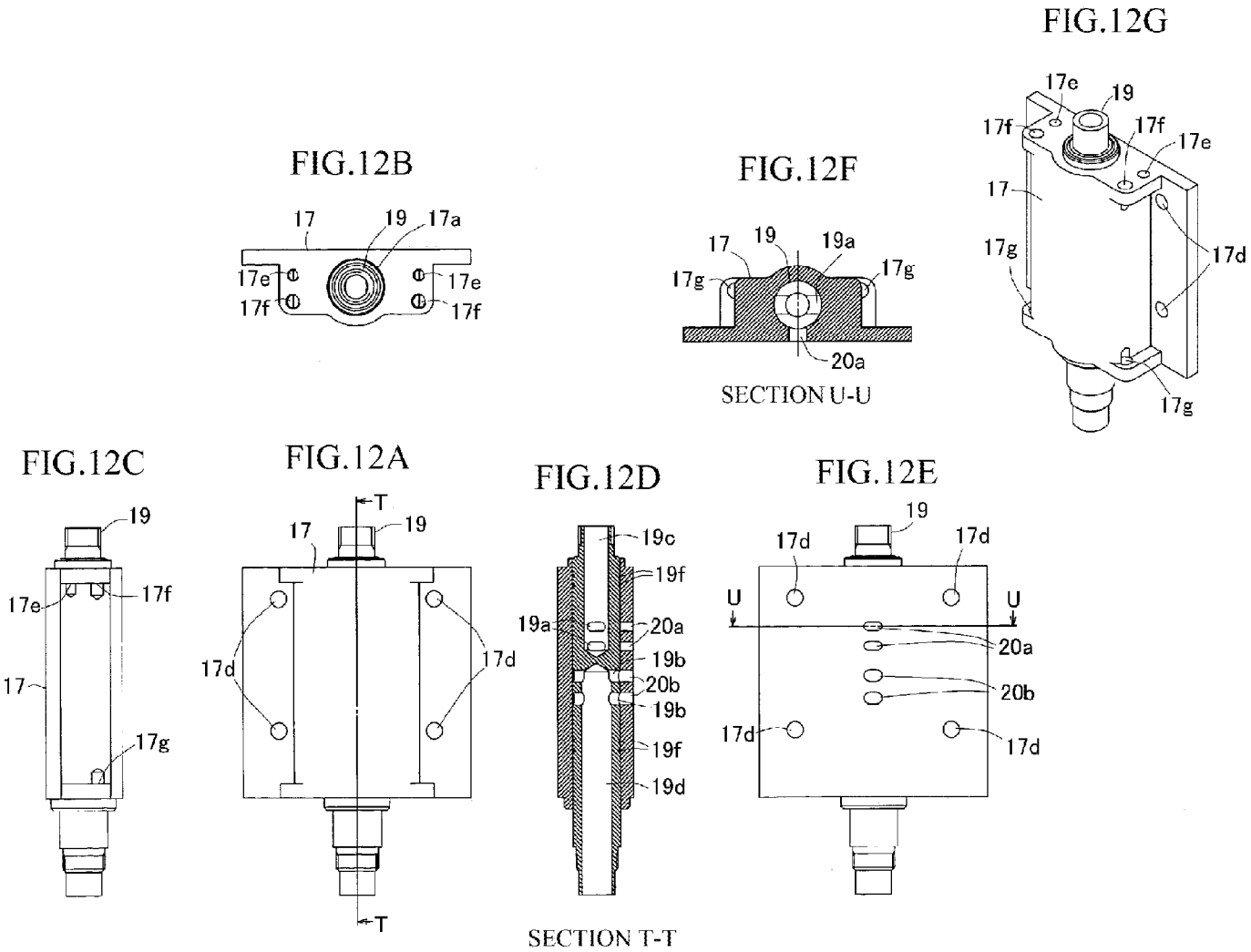
FIGS. 12A-12G are a front view, a plan view, a left side view, a vertical sectional view taken along a line T-T, a rear view, a sectional view taken along a line U-U and a perspective view of another cylinder head section.

The intake communication channels 20*a* and the discharge communication channels 20*b* of the cylinder head section 17 are formed in a part in which a surface including the axis of the cylinder 16 and the axis of the rotary valve 19 intersects with the cylinder head section 17. Namely, as shown in FIG. 12E, the intake communication channels 20*a* and the discharge communication channels 20*b* are serially arranged. By linearly arranging the valve through-hole 17*a*, the intake communication channels 20*a* and the discharge communication channels 20*b*, the processing holes 17*b* shown in FIGS. 8A-8G may be omitted, so that a process of drilling the cylinder head sections 17 can be easier, the communication channels to the cylinder chambers 22 can be shortened, the dead spaces can be reduced and output efficiency can be improved. Further, as shown in FIG. 13, the projecting sections 7*e* and 8*e* formed in the ring pressers 7*d* and 8*d* of the first and second double-headed piston units 7 and 8 are linearly formed.

Successively, FIGS. 13-1 to 13-4 are explanation views showing relationships between the open-close actions of another rotary valve for the turbine and the positions of the piston. In FIGS. 13-1 to 13-4, the output shaft is rotated from 0 to 270 degrees (i.e., the rotary valve is rotated from 0 to −135 degrees). The intake communication channel 20*a* formed in the cylinder head section 17 is shown in upper parts, and the discharge communication channel 20*b* is shown in lower parts. Any of the pistons may be used for explanation, but the second piston (i.e., one side of the second double-headed piston unit 8) will be explained. Note that, in case of the turbine, the speed reduction mechanism 24 reduces a rotational speed of the rotary valve 19 to 1/2 of the output shaft 4. The rotational direction of the rotary valve 19 is an opposite direction (e.g., counterclockwise direction (the angle is indicated with the minus-sign)) of that of the shaft 4 (e.g., clockwise direction). Note that, the intake cycle and the discharge cycle are the same as those of the example shown in FIG. 11, so their explanation will be omitted.

If one intake hole 19*a* and one discharge hole 19*b* are formed in the rotary valve 19, the speed reduction ratio can be one. Further, as shown in FIG. 13-5, three intake holes 19*a* and three discharge holes 19*b* may be arranged in the circumferential direction of the rotary valve 19 so as to make the speed reduction ratio of the speed reduction mechanism 24 1/3, so the speed reduction ratio can be optionally set.

As described above, the intake communication channels 20*a* and the discharge communication channels 20*b* of the cylinder head section 17 are formed in the part where the surface including the axis of the cylinder 16 and the axis of the rotary valve 19 intersects with the cylinder head section 17, so that the structures of the intake communication channels 20*a* and the discharge communication channels 20*b*, which make the cylinder chambers 22 communicate with the rotary valve 19, can be simplified, and a production cost can be reduced.

As described above, the rotary valves 19, which are rotated by drive transmission from the shaft and each of which has the intake holes and the discharge holes being alternately communicated with the cylinder chamber via the communication channels, are respectively provided to the cylinder heads which close the cylinder chambers, so that the communication channels between the cylinder chambers and the rotary valves can be very short, the dead spaces can be reduced as much as possible, and the output efficiency can be improved.

In case that the fluid rotary machine is the internal-combustion engine, the communication channels, which are formed in the cylinder head so as to communicate each of the cylinder chambers with the intake holes or the discharge holes of the rotary valve, are symmetrically formed with respect to the surface including the axis of the cylinder and the axis of the rotary valve, so that the side pressure, which is applied to the rotary valve 19 when the double-headed piston is lifted to the upper dead center by the explosion cycle performed in the cylinder chamber, can be cancelled by the communication channels 20*a* and 20*b* which are symmetrically formed. Therefore, smooth rotations of the rotary valves 19 can be secured.

Preferably, the projecting sections, which are capable of entering the communication channels, are formed in the piston head sections so as to reduce the dead spaces. By advancing the projecting sections of the piston head sections into the communication channels, which communicate the cylinder chambers with the rotary valves, the fluid can be released, the dead spaces can be further reduced, and the output efficiency can be improved.

The first and second balance weights 9 and 10 are integrally attached to the both axial ends of the first crank shaft 5, and the output shafts 4*a* and 4*b* are integrally attached to the first and second balance weights 9 and 10, so that the simple crank mechanism, in which number of mechanical parts, e.g., crank shaft, crank arm, can be smaller than that of a conventional crank mechanism, can be realized, and the four-cycle engine, in which rotational balances of mechanical parts of the engine can be easily produced, vibration and noise can be reduced and energy loss can be reduced, can be provided.

The fluid rotary machine can be widely applied to not only an internal-combustion engine and an external-combustion engine, e.g., turbine, but also an air engine, etc.

Further, the speed reduction mechanism is not limited to the above described embodiments, so the rotary valves may be respectively connected to the gear of the output shaft by, for example, connection gears.

What is claimed is:

1. A fluid rotary machine in which first and second double-headed pistons intersecting within a case body move linearly back and forth within cylinders due to the hypocycloid principle along with rotation of shafts, and in which intake and exhaust cycles are repeated in chambers, wherein cylinder heads for closing the cylinder chambers are each provided with rotary valves which are rotated by drive transmission from the shafts and which are provided with intake holes and discharge holes alternately communicated with the cylinder chambers via communication channels, and the rotary valves intersect longitudinal axis of the opposing pistons and are capable of rotating parallel with output axis lines, said fluid rotary machine includes a plurality of pairs of arc-shaped slits, having phases that are mutually shifted in a circumferential direction, being formed in each of the rotary valves and arranged in the longitudinal direction thereof.

2. The fluid rotary machine according to claim 1, wherein the communication channels, which are formed in the cylinder heads so as to communicate each of the cylinder chambers with the intake holes and the discharge holes of the rotary valves, are symmetrically formed with respect to a surface including an axis of the cylinder and an axis of the rotary valve.

3. The fluid rotary machine according to claim 1, wherein projecting sections, which can enter the communication channels so as to reduce dead spaces, are formed in piston head sections.

4. The fluid rotary machine according to claim 1, wherein the rotary valves are rotated by a speed reduction mechanism, which reduces revolution numbers of the shafts and transmits rotations thereof.

5. A fluid rotary machine in which first and second double-headed pistons intersecting within a case body move linearly back and forth within cylinders due to the hypocycloid principle along with rotation of shafts, and in which intake and exhaust cycles are repeated in chambers, wherein cylinder heads for closing the cylinder chambers are each provided with rotary valves which are rotated by drive transmission from the shafts and which are provided with intake holes and discharge holes alternately communicated with the cylinder chambers via communication channels, and the rotary valves intersect longitudinal axis of the opposing pistons and are capable of rotating parallel with output axis lines, and projecting sections, which can enter the communication channels so as to reduce dead spaces, are formed in piston head sections.

6. The fluid rotary machine according to claim 5, wherein the communication channels, which are formed in the cylinder heads so as to communicate each of the cylinder chambers with the intake holes and the discharge holes of the rotary valves, are symmetrically formed with respect to a surface including an axis of the cylinder and an axis of the rotary valve.

7. The fluid rotary machine according to claim 5, wherein the rotary valves are rotated by a speed reduction mechanism, which reduces revolution numbers of the shafts and transmits rotations thereof.

* * * * *